US010825406B2

(12) United States Patent
Suzuki et al.

(10) Patent No.: US 10,825,406 B2
(45) Date of Patent: Nov. 3, 2020

(54) LCD DISPLAY BACKLIGHT CONTROL SYSTEM

(71) Applicant: Microsoft Technology Licensing, LLC, Redmond, WA (US)

(72) Inventors: Nobuyuki Suzuki, Mercer Island, WA (US); John Patrick Fogarty, Seattle, WA (US); Aaron Gilbert Moo, Seattle, WA (US); Kari Jussi Ropo, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/269,934

(22) Filed: Feb. 7, 2019

(65) Prior Publication Data

US 2020/0105209 A1 Apr. 2, 2020

Related U.S. Application Data

(60) Provisional application No. 62/738,951, filed on Sep. 28, 2018.

(51) Int. Cl.
*G09G 3/36* (2006.01)
*G09G 3/32* (2016.01)

(52) U.S. Cl.
CPC ..... *G09G 3/36* (2013.01); *G09G 3/32* (2013.01); *G09G 2310/08* (2013.01); *G09G 2320/0626* (2013.01)

(58) Field of Classification Search
CPC .... G09G 3/36; G09G 3/32; G09G 2320/0626; G09G 2310/08
See application file for complete search history.

(56) References Cited

U.S. PATENT DOCUMENTS

| | | | |
|---|---|---|---|
| 8,184,089 | B2 | 5/2012 | Botzas et al. |
| 8,203,523 | B2 | 6/2012 | Han et al. |
| 8,659,535 | B2 | 2/2014 | Hwang et al. |
| 8,723,784 | B2 | 5/2014 | Adachi |

(Continued)

OTHER PUBLICATIONS

"International Search Report and Written Opinion Issued in PCT Application No. PCT/US2019/039128", dated Aug. 20, 2019, 11 Pages.

(Continued)

*Primary Examiner* — Ibrahim A Khan
(74) *Attorney, Agent, or Firm* — Alleman Hall Creasman & Tuttle LLP

(57) ABSTRACT

A backlight control system is provided. A modulation value register is included in memory of the system. A display backlight is included in the system, the display backlight including a light emitting diode (LED) light source configured to illuminate a liquid crystal display (LCD). Processing circuitry included in the system is configured to execute a clock timer and a temporal dither pattern generator. The temporal dither pattern generator is configured to receive a modulation value from the modulation value register, and apply a temporal dither according to a signal from the clock timer to the modulation value to generate a dithered modulation value. A modulator executed by the processing circuitry is configured to receive the dithered modulation value and modulate a power signal according to the dithered modulation value to drive the display backlight.

12 Claims, 10 Drawing Sheets

(56) References Cited

U.S. PATENT DOCUMENTS

| | | | | |
|---|---|---|---|---|
| 8,817,056 | B2 | 8/2014 | Park | |
| 9,380,668 | B2 | 6/2016 | Tyrrell | |
| 2003/0011545 | A1* | 1/2003 | Sagano | G09G 3/22 345/76 |
| 2005/0057484 | A1 | 3/2005 | Diefenbaugh et al. | |
| 2006/0001659 | A1* | 1/2006 | Plut | G06F 1/3218 345/211 |
| 2007/0164654 | A1* | 7/2007 | Koga | H05B 45/37 313/495 |
| 2008/0094426 | A1 | 4/2008 | Kimpe | |
| 2008/0122832 | A1* | 5/2008 | Chen | G09G 3/32 345/214 |
| 2012/0019160 | A1* | 1/2012 | Lee | H05B 45/10 315/291 |
| 2012/0044277 | A1* | 2/2012 | Adachi | G09G 3/3426 345/690 |
| 2012/0068978 | A1* | 3/2012 | Aitken | G09G 3/3406 345/207 |
| 2012/0139968 | A1* | 6/2012 | Adachi | G09G 3/3426 345/690 |
| 2012/0287141 | A1* | 11/2012 | Higgins | H04N 19/98 345/581 |
| 2013/0082618 | A1* | 4/2013 | Hussain | G09G 3/3406 315/210 |
| 2013/0088171 | A1* | 4/2013 | Fensore | H05B 45/37 315/307 |
| 2014/0139498 | A1* | 5/2014 | Hussain | G09G 3/342 345/204 |
| 2015/0076999 | A1* | 3/2015 | Malinin | H05B 45/24 315/186 |
| 2016/0139266 | A1* | 5/2016 | Montoya | G01S 17/32 356/5.01 |
| 2016/0370915 | A1* | 12/2016 | Agarwal | G06F 3/0416 |
| 2017/0091960 | A1* | 3/2017 | Wang | G09G 3/2003 |
| 2017/0358255 | A1* | 12/2017 | Wang | G09G 3/2055 |
| 2019/0059136 | A1* | 2/2019 | Navabi-Shirazi | H05B 45/37 |

OTHER PUBLICATIONS

"LP8553 High-Efficiency LED Backlight Driver for Notebooks", Retrieved From: http://www.ti.com/lit/ds/symlink/lp8553.pdf, Sep. 2011, 42 Pages.

* cited by examiner

LCD DISPLAY BACKLIGHT CONTROL SYSTEM

CROSS REFERENCE TO RELATED APPLICATIONS

This application claims priority to U.S. Provisional Patent Application Ser. No. 62/738,951, filed Sep. 28, 2018, the entirety of which is hereby incorporated herein by reference for all purposes.

BACKGROUND

Devices incorporating LED-backlit liquid crystal displays (LCDs), including computer monitors and communication devices, may include luminance control systems to dim or brighten the display. Digital linear current modulation and/or digital linear pulse width modulation may be applied to modulate the LED current of the backlight in order to control LCD luminance. An output waveform from a modulator may control a power signal so that temporal average power applied to the LED may be modulated. The modulator may have a resolution that depends on its capacity, e.g., an 8-bit or 10-bit modulator.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

A backlight control system is provided. The control system may include memory that may include a modulation value register. The control system may also include a display backlight, which may include a light emitting diode (LED) light source configured to illuminate a liquid crystal display (LCD) display. Processing circuitry may be configured to execute a clock timer and a temporal dither pattern generator. The temporal dither pattern generator may be configured to receive a modulation value from the modulation value register and may apply a temporal dither according to a signal from the clock timer to the modulation value to generate a dithered modulation value. A modulator that may be executed by the processing circuitry may be configured to receive the dithered modulation value and may modulate a power signal according to the dithered modulation value to drive the display backlight.

DETAILED DESCRIPTION

The inventors have recognized the following challenges in controlling luminance level changes in an LED-backlit liquid crystal display (LCD) in a display device. If changes in luminance are too jagged, that is, if a stepwise change in luminance is too large, a user may find viewing of the display disruptive. Thus, a smooth change to luminance, where luminance change steps are less noticeable to a user, may improve user experience with a display device. However, technical challenges exist to providing smooth changes in backlight luminance. Temporal average power applied to the LED may be modulated to produce changes in the LCD luminance, either by modulating the digital linear current or digital linear pulse width modulation as applied to the LED current. The smallest degree of modulation in an existing system may result in a change in luminance that is so perceptible to the human eye when the display is brightened or dimmed as to be undesirable, for example a change on the order of 4 nits (candela/$m^2$). In such a system, the degree of modulation granularity may be decreased by specifying higher performance hardware components such as a higher pulse width clock timer or larger digital-analog converter; however, there is also an increased cost and time-to-market delay associated with changing an existing design to incorporate such components. Given these challenges, the inventors have developed a backlight control system that does not require higher performance hardware componentry, but rather utilizes a dither control scheme to achieve improved granularity, thereby avoiding the need for costly and time-consuming hardware design changes.

Figure 1:
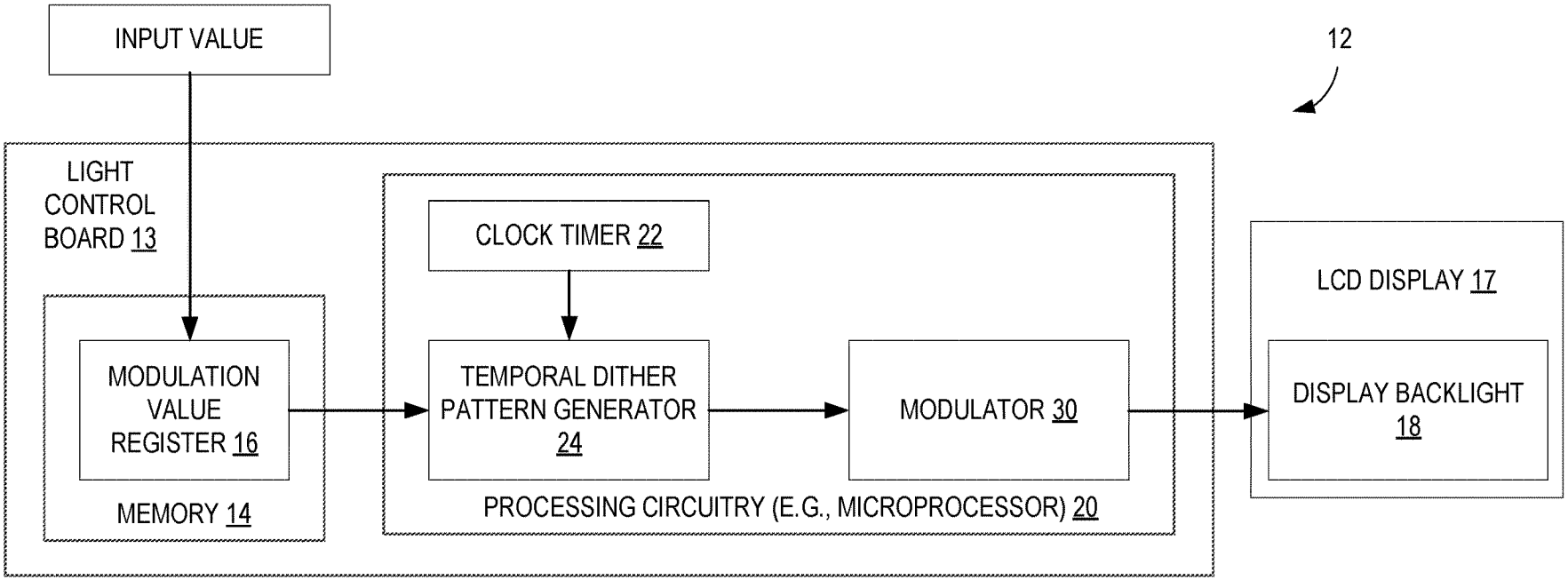
FIG. 1 shows a schematic view of an example implementation of a backlight control system.

FIG. 1 shows an example implementation of a backlight control system 12. The backlight control system 12 may include a light control board 13 to which a memory 14 including a modulation value register 16 is mounted. The light control board may be configured to drive a display backlight 18. The display backlight 18 may incorporate an LED light source, the current to which may be modulated by the light control board 13 to control changes in luminance of the LED light source. Processing circuitry 20 such as a microprocessor may be mounted to the light control board and configured to execute a clock timer 22 and a temporal dither pattern generator 24. The clock timer may be a hardware timer or software timer, as appropriate. The temporal dither pattern generator 24 may be a program executed by the processing circuitry or may be custom built hardware circuitry, and may be configured to receive a modulation value 26 from the modulation value register 16 and subsequently apply a temporal dither according to a signal from the clock timer 22 to the modulation value 26. The application of the temporal dither may generate a dithered modulation value 28. A modulator 30, which likewise may be a program executed by the processing circuitry or custom-built hardware circuitry, may be configured to receive the dithered modulation value 28 and modulate a temporal average power signal according to the dithered modulation value 28 to drive the display backlight 18. The temporal dither pattern generator 24 may apply the temporal dither to the modulation value 26 to generate a dithered modulation value 28 that increases a number of illumination value steps of the display backlight 18.

Figure 2A:
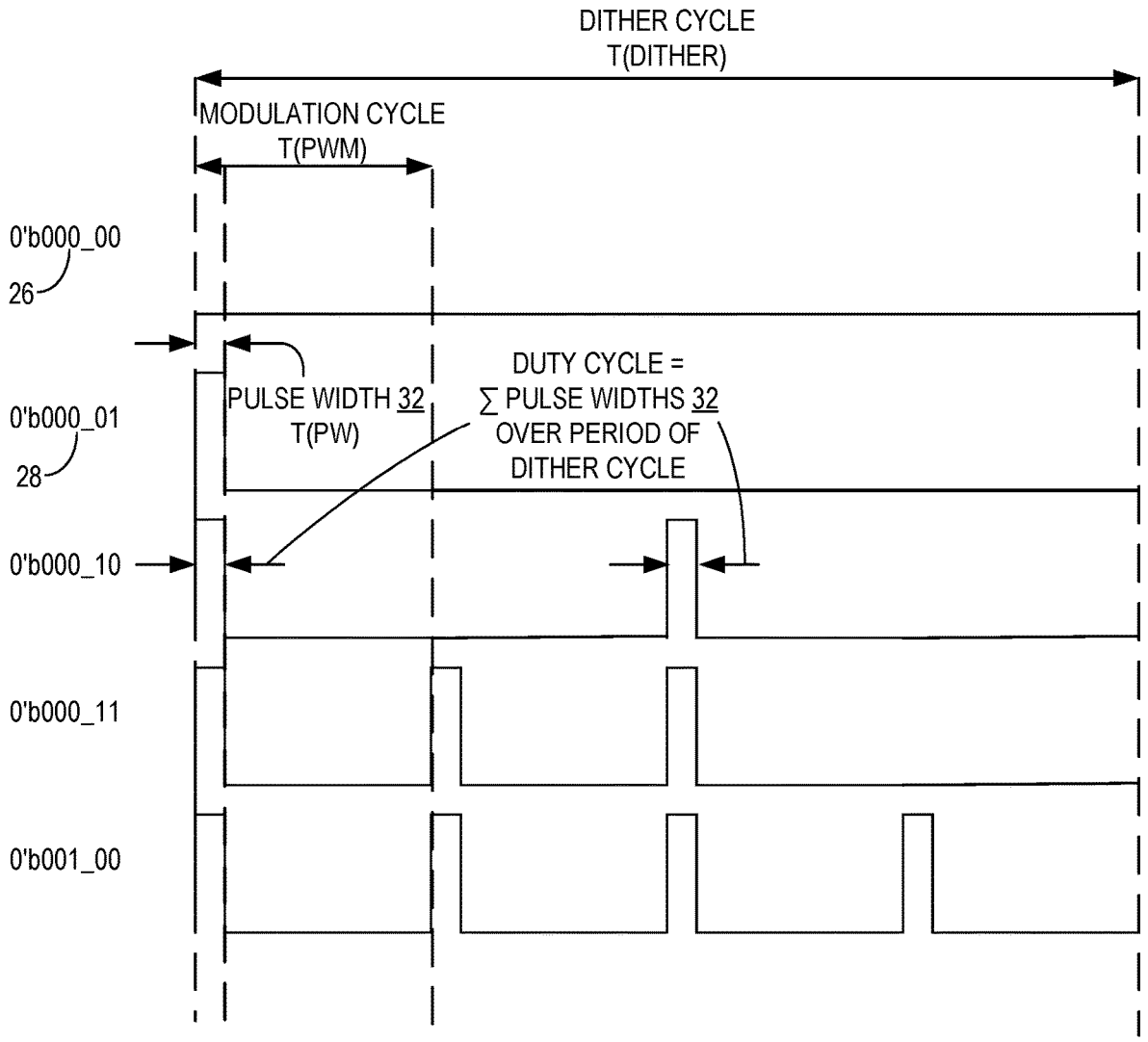
FIG. 2A is a diagram of dithered modulation values generated by the control system, according to an example implementation.

Referring to FIG. 2A, a description of an example implementation of the backlight control system 12 follows. FIG. 2A shows a pulse output waveform that controls the luminance of the display backlight 18 at several different modulation values 26 and dithered modulation values 28. In this example, the modulation value resolution of the modulation value register 16 is 5 bit, or 32 step. The modulator 30 has a modulator resolution that is 3 bit, or 8 step. Consequently, the minimum pulse width of pulse width 32, T(PW), is ⅛ of the modulation cycle T(PWM). The temporal dither pattern generator 24 has a 2-bit dither capacity, and thus the dither cycle T(Dither) is T(PWM)×4. The dither cycle, T(Dither), is a cycle in the waveform over which dithering may occur. In FIG. 2A, when the modulation value 26 is 0'b000_00, there is no pulse. At a modulation value 26 with dithered modulation value 28 0'b000_01, there is one pulse out of the total of 4T(PWM)=T(Dither). At 0'b000_10, there are two pulses out of the total of 4T(PWM)=T(Dither). At 0'b000_11, there are three pulses out of the total of 4T(PWM)=T(Dither). When the modulation value 26 is 0'b001_00, the number of pulses is four, which is the total number of pulses for one dither cycle in this example.

Figure 2B:
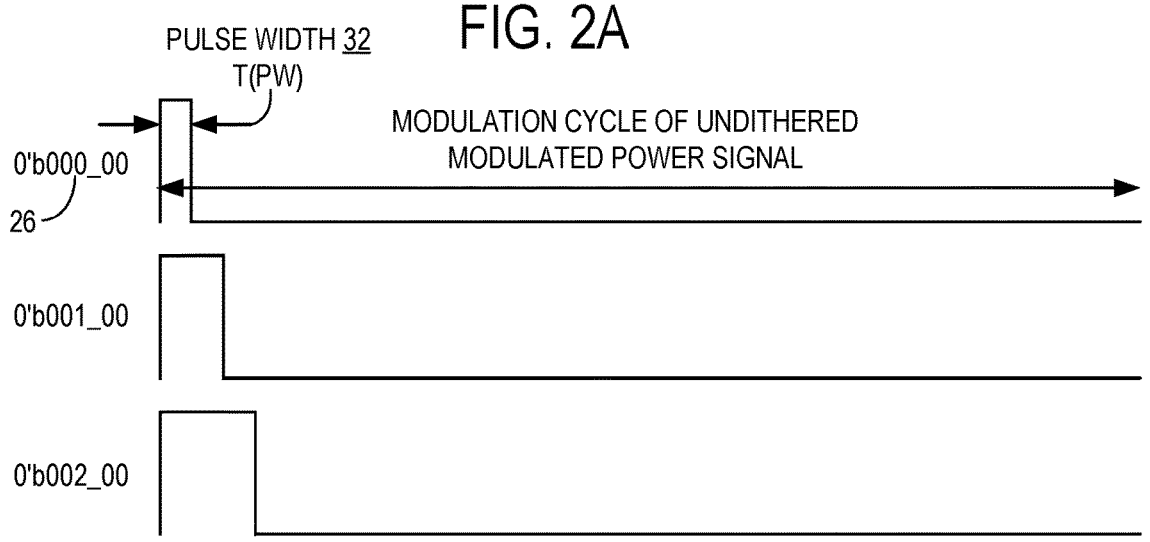
FIG. 2B is a diagram of conventional power signal modulation without dithering.

To contrast with the dithering of the signal as described for FIG. 2A, FIG. 2B is a diagram representing a power signal modulation without dithering. It will be appreciated that although only one pulse is shown for each level, the pulse would be emitted repeatedly over each modulation cycle in the output waveform. As there is no dithering, the illumination value steps only occur through changes to the pulse with 32. Thus, while there are four steps between the modulation value 26 of 0'b000_00 and that of 0'b001_00 in FIG. 2A, there is only one step between the same modulation values 26 in FIG. 2B. From modulation value 26 of 0'b001_00 to that of 0'b002_00, the pulse width 32 increases again to increase the illumination by another step. However, it will be appreciated that with respect to the dithered signal in FIG. 2A, the illumination steps are coarser and fewer steps are possible overall. The coarse illumination steps with the undithered modulation cycle produced by the power signal modulation of FIG. 2B are illustrated in solid line in FIG. 3A. Changes of such coarseness may be visible to the human eye, which is generally undesirable.

For the example in FIG. 2A, it should be noted that the total number of steps possible over the entire modulation cycle T(PWM) is 29. When the modulation value 26 with dithered modulation value 28 is 0'b007_01, the pulse width 32 is at a maximum of the modulation cycle T(PWM). This level will be equal to the maximum amount of luminance that is generated at the display backlight 18. To explain graphically, it may be observed that when the pulse width 32 in FIG. 2A is at a maximum width equaling T(PWM), the pulse output waveform is at a continuous maximum. As an additional example, when the modulator 30 has a modulator resolution that is 5 bit, or 32 step, and the temporal dither pattern generator 24 has a 2-bit dither capacity, the dither cycle T(Dither) being T(PWM)×4, the total number of steps possible over the entire modulation cycle T(PWM) is 125. This is, again, because at the maximum pulse width of the modulation cycle T(PWM) the maximum amount of luminance is generated at the display backlight 18 and no further dithering of the signal is possible.

It will be appreciated that the number of illumination value steps at which the display backlight 18 is controlled to be illuminated may not be limited to, i.e. may differ from, a modulation value resolution of the modulation value register 16. In the example above, the total number of steps possible over the entire modulation cycle T(PWM) is 29, and the modulation value resolution of the modulation value register 16 is 5 bit, or 32 step. Thus, the modulation value register 16 may accommodate values for each of the 29 actual steps. However, were the modulation value register 15 only 4 bit, or 16 step, because the modulation source, the modulator 30, has a resolution that is 3 bit or 8 step with a 2 bit dither capacity, 29 steps are still possible. It will also be appreciated that, given these examples, a modulation value resolution of the modulation value register 16 may be greater than a modulator resolution of the modulator 30. This may be one potential advantage of the backlight control system 12, in that a lower resolution or lower capacity modulator 30 may be incorporated into the system 12 while a higher resolution of steps is actually possible via implementation of the temporal dither pattern generator 24. To summarize, the system 12 does not require the modulation value resolution of the modulation value register 16 to be equal to the modulator resolution of the modulator 30 multiplied by the dither capacity.

It will be appreciated that the temporal dither may be applied at least when the modulator 30 executes at one pulse width 32 within a dither cycle. To accommodate the specifications of a given backlight control system 12, display backlight 18, and luminance possible or desired for the system 12, the temporal dither may be applied to the modulator for only a portion of modulation values 26. Alternatively, the temporal dither may be applied when the modulator 30 executes at a plurality of the pulse widths, or at all of the pulse widths 32 within a dither cycle, as in the examples above.

Figure 3A:
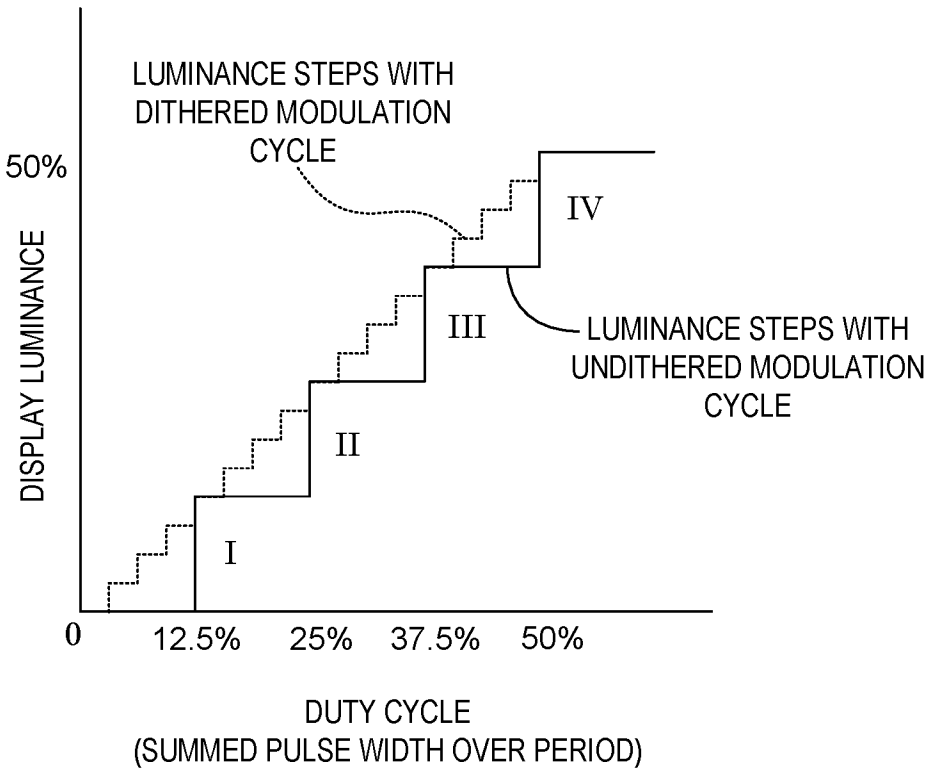
FIG. 3A is a plot showing display luminance vs. duty cycle of the backlight control system of FIG. 1., with and without dithering.

FIGS. 3A-3E show examples of modulation cycles with dithering. FIG. 3A is a plot showing display luminance vs. duty cycle of the backlight control system of FIG. 1, with and without dithering. In FIG. 3A, a solid line indicates coarser changes in display luminance using a pulse width modulator that is not dithered, such as the example of FIG. 2B, and a dotted line indicates finer changes in display luminance with dithering performed. Without dithering, the solid line shows four levels of luminance (levels I-IV), each level corresponding to a change in the pulse width. It will be appreciated that the human eye perceives a time average of pulses rather than the individual pulses. As such, each time an increase in pulse width occurs, the generated pulses are perceived as an increase over a time-average so that an incremental increase in pulse width is perceived as an increase in brightness as the eye receives the light pulses repeatedly over time. With dithering as shown in FIG. 2A, it may be possible to add pulses within a dithering cycle that may otherwise not occur between levels of the undithered signal.

In FIG. 3A, between each level 0-IV, without dithering there would only be a pulse width change in the waveform from level to level. With dithering, a predetermined number of intermediate steps (four steps in the example illustrated in FIG. 3A) of luminance change may be possible between each of the levels 0-IV. To reiterate from above, the human eye would perceive the increases of brightness as repeated cycles of pulses are received, whether as a pulse width change in the undithered wave form or as changes in pulse width and number of pulses per cycle as shown in the example dithered waveform. In an example where the modulator 30 has a resolution that is 3 bit, or 8 step, the total number of steps without dithering is 8. For the sake of simplicity, only the first four luminance steps I-IV with an undithered modulation cycle are shown with the solid line in FIG. 3A. Where the modulation value register 16 is 5 bit, or 32 step and the temporal dither pattern generator 24 has a 2-bit capacity, T(PWM)×4=T(Dither) and there are 32 steps possible for the dithered signal (in practice, as discussed above, the actual number of possible steps in this case is 29). Again, for the sake of simplicity, only half the number of steps is represented in FIG. 3A; for the undithered signal represented by the dotted line, this is 16 steps. Thus, the duty cycle of the undithered signal is at 50% after four steps and the duty cycle of the dithered signal is at 50% after 16 steps.

Figure 3B:
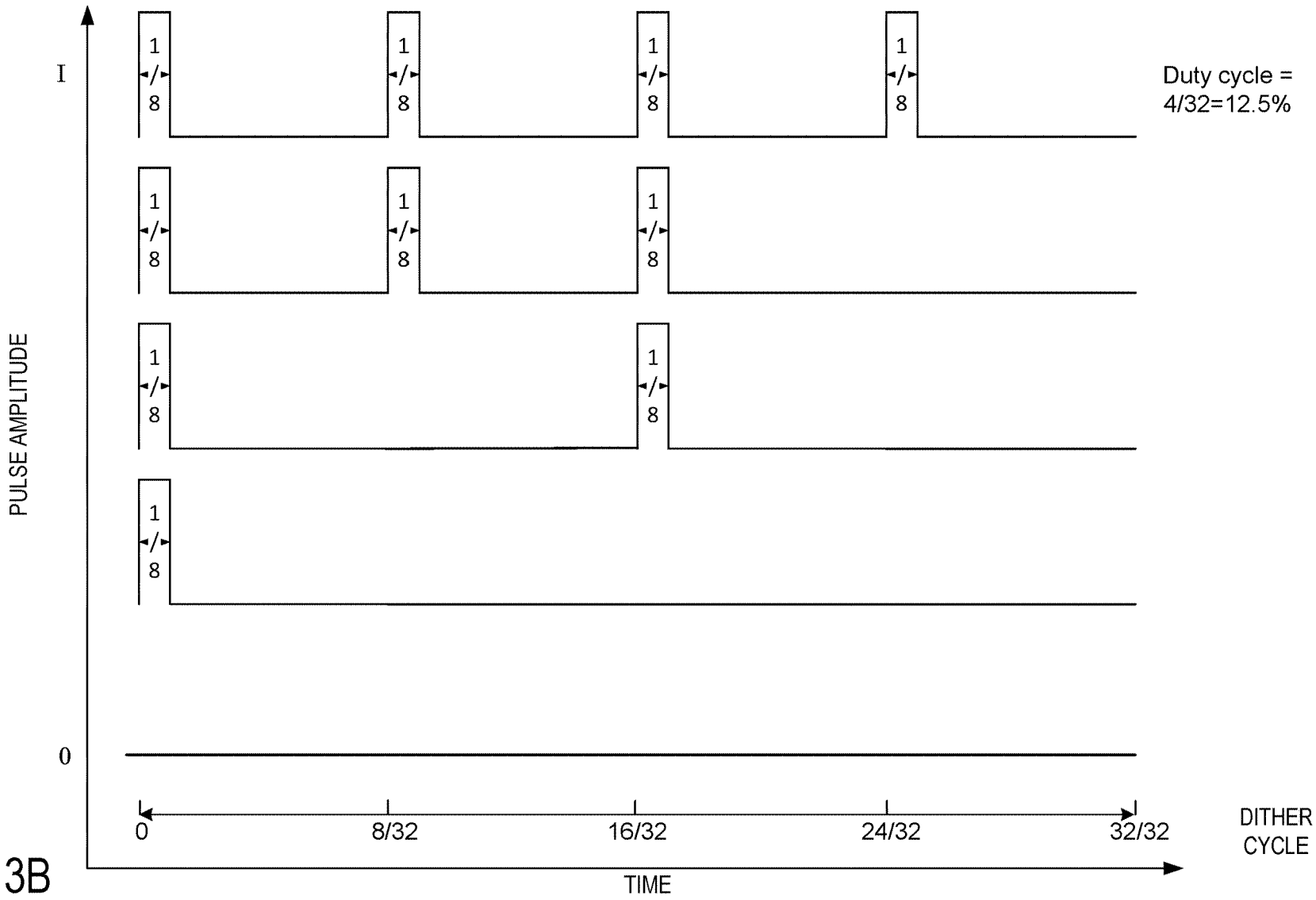
FIGS. 3B-3E are diagrams showing modulation cycles with dithering according to an example implementation.

To demonstrate a graphical example for the dithered signal, in FIG. 3B the pulse output waveforms corresponding to each of a plurality of luminance steps are shown over one dither cycle. Pulse amplitude is shown vertically and time is shown horizontally. Also included in this figure is a horizontal scale as reference for a duty cycle calculation; an example value of duty cycle is shown for level I. At level 0, no pulse is output. For each level between level 0 and level I, an additional pulse is output according to the dithered signal. In this example, the minimum pulse width of pulse width 32, T(PW), is ⅛ of the modulation cycle T(PWM). With dithering, it may be seen that four steps of luminance are output via four different pulse output waveforms up through level I. Without dithering, only a single jump between levels 0 and I may be possible, corresponding to a jump in the solid line in FIG. 3A. The pulse output waveform is generated similarly as shown in FIG. 2A, however in FIG. 3B increasing luminance is shown in the upward direction (toward the top of the page).

Figure 3C:
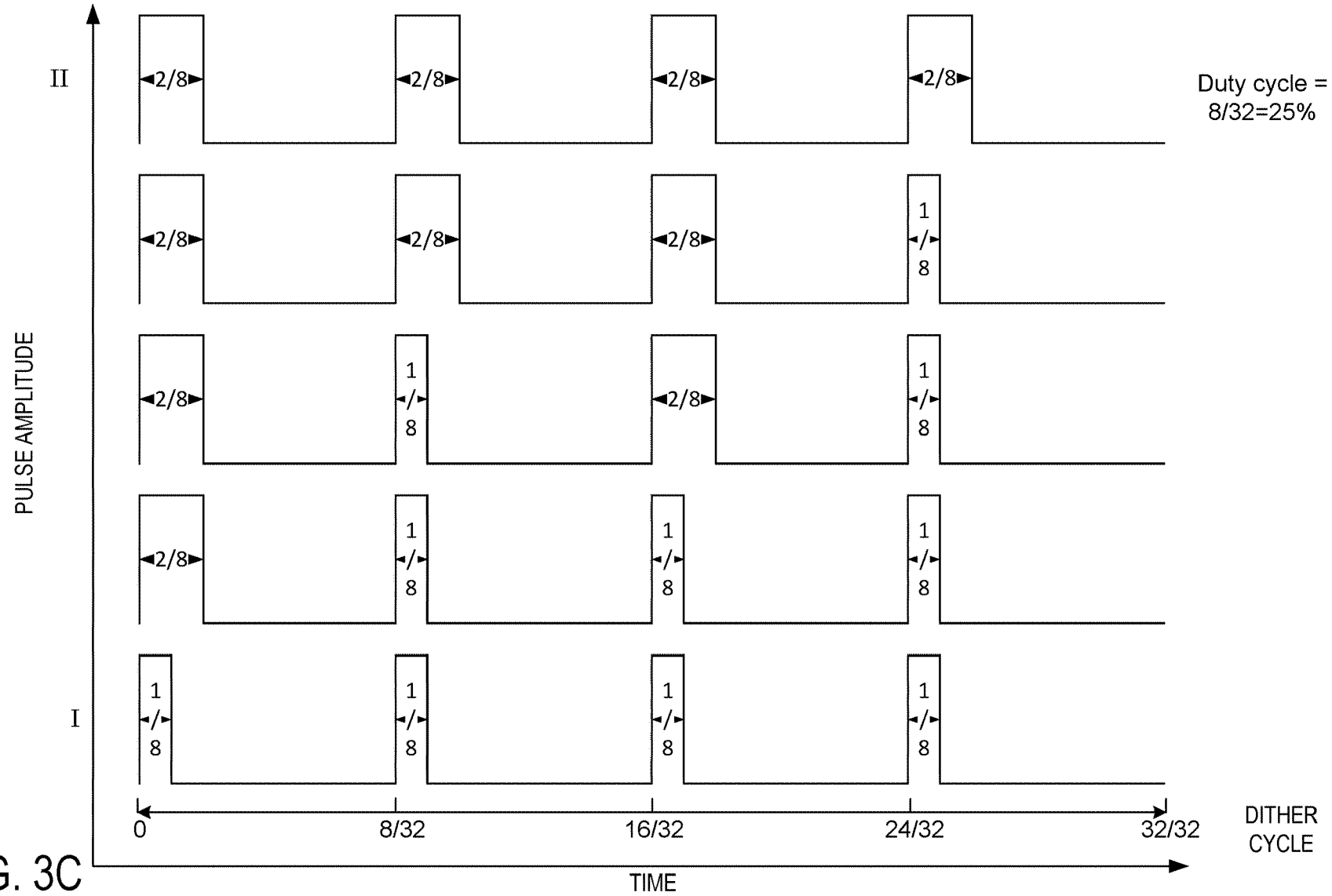
Figure 3D:
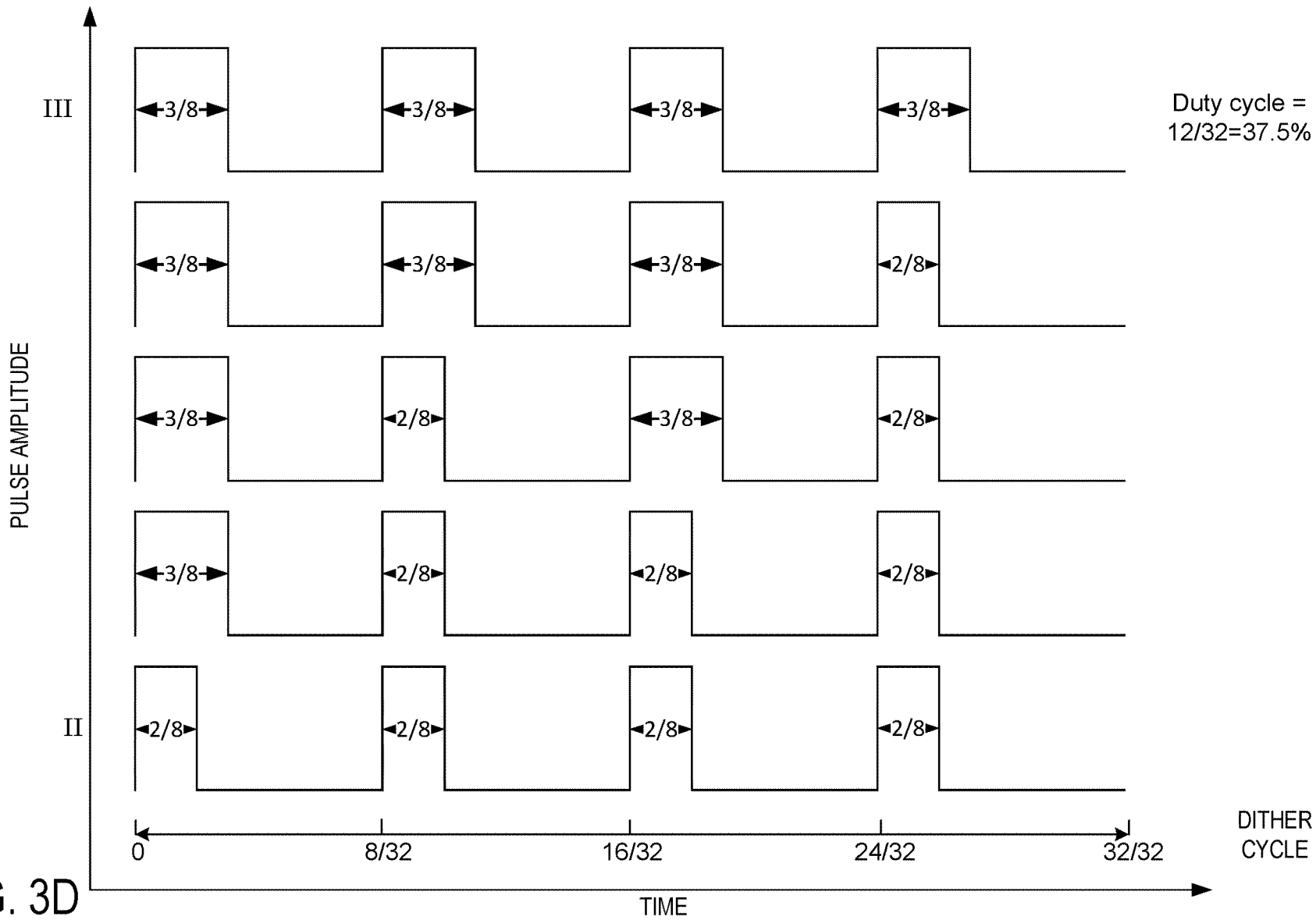
Figure 3E:
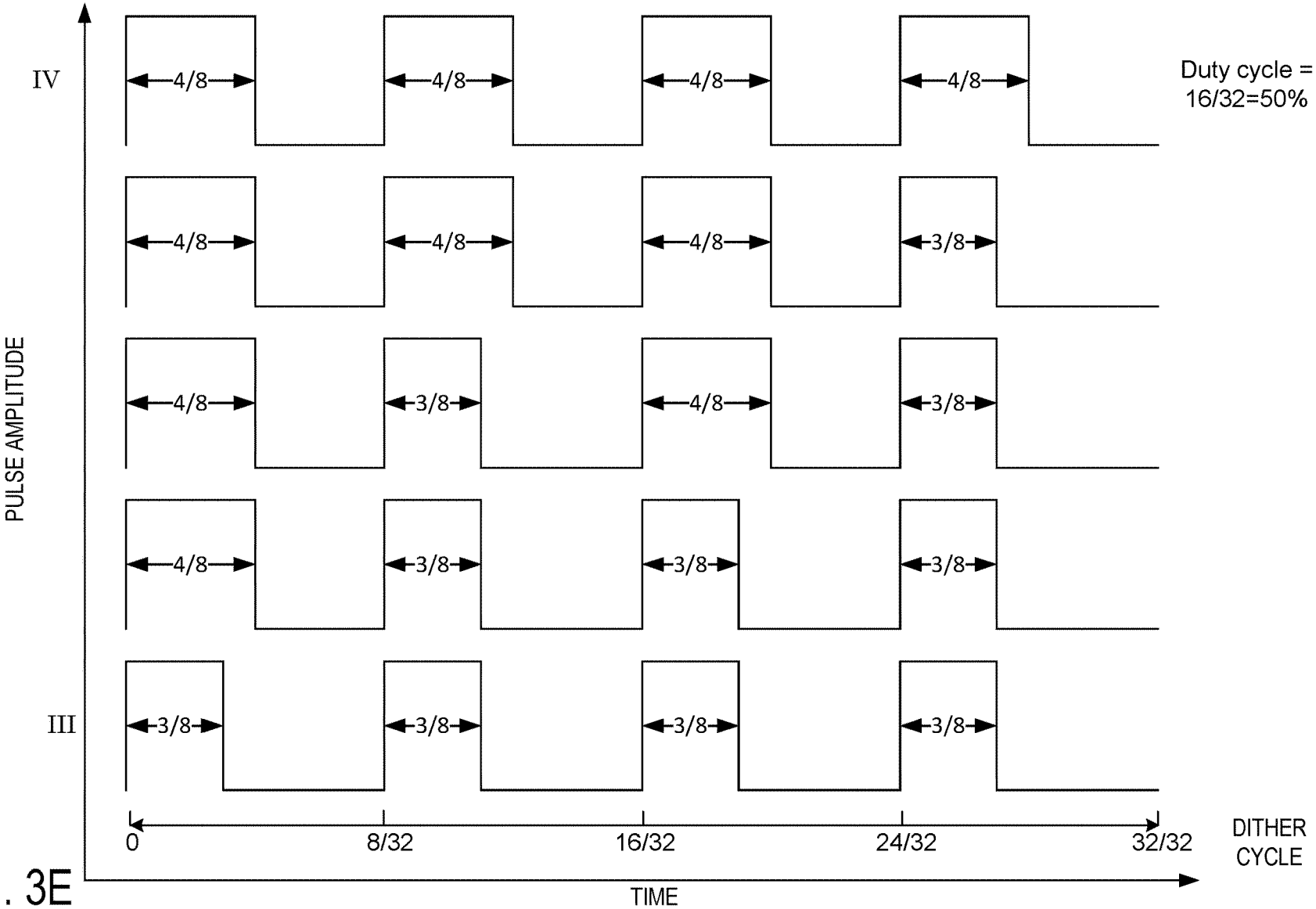

FIG. 3C is similar to FIG. 3B but depicts an increase in luminance between levels I and II; again, without dithering the modulator 30 would merely output a change in the pulse width at level II without the intervening levels shown in FIG. 3C. With dithering, four luminance levels are possible by changing the pulses within the dithering cycle, T(Dither). The example implementation shown in FIG. 3C shows one method by which dithering may be accomplished to maintain even steps of luminance increase, as the time average of the pulse output waveform is perceived by the user. In FIG. 3C, at the bottom row of level I all pulses have a width of (⅛) of the modulation cycle. At one brightness level greater, which is the second row from the bottom, one wider pulse (⅜) appears. This is followed by two wider pulses (⅜) at the third row from the bottom which is one level of brightness greater than the brightness of the second row from the bottom. This pattern continues until at level II at the top row, the fifth row from the bottom, all pulses are of a width of (⅜). Similar patterns with increasing pulse widths are shown in FIGS. 3D and 3E from levels II to III and III to IV, respectively.

To reiterate, from levels I to IV in the previous example 16 steps of luminance using dithering are realized, where only four luminance steps were originally available using undithered modulation. It will be appreciated that other implementations may be possible where the step size or pulse widths of the pulse output waveform output by the modulator 30 vary in width or pattern to achieve the luminance level changes desired for the specific display system.

The temporal dither pattern generator 24 may be included in a hardware component that may be an application-specific integrated circuit (ASIC), a field-programmable gate array (FPGA), an integrated circuit, and/or a microcontroller. Choice of temporal dither pattern generator 24 may be suited to the specifications of the backlight control system 12. Within the system 12, the temporal dither pattern generator 24 may be included on the processing circuitry 20, which may be included on a light control board 13 of the system 12. A display device incorporating a plurality of microcontrollers may assign modulation as a task to one microcontroller. It will be appreciated that the modulation value register 16 may be a software register that may be read by another service of the operating system, namely the temporal dither pattern generator 24. The clock timer 22 may also be a software component, the output of which may be written to the temporal dither pattern generator 24 and also to the modulator 30. As a hardware component, the modulator 30 may be written to with a periodic signal from the modulation value register 16 as modified by the temporal dither pattern generator 24.

The modulator 30 may execute at least one modulation that is pulse width modulation and/or current modulation. A potential advantage of using pulse width modulation or current modulation in system 12 is that it may be easily implemented into existing control systems for display devices. The dither cycle T(Dither) may be less than 16.7 milliseconds, which stated in terms of frequency is dithering at higher than at 60 Hz, since lower cycle temporal dithering may be perceived as no longer continuous by the human eye. Also, the modulation cycle may be greater than 10 microseconds, which stated in terms of frequency is modulation lower than at 100 kHz. It will be appreciated that, although state-of-the-art LED drivers may work at frequencies up to 100 kHz, a range of 60 Hz to 10 kHz may be implemented without expensive or sophisticated high-speed modulation in the system 12. Thus, the temporal dither applied by the temporal dither pattern generator 24 may have a frequency of greater than 60 Hz and the modulator may be configured to modulate the modulated power signal at a modulation frequency of less than 100 kHz.

Figure 4:
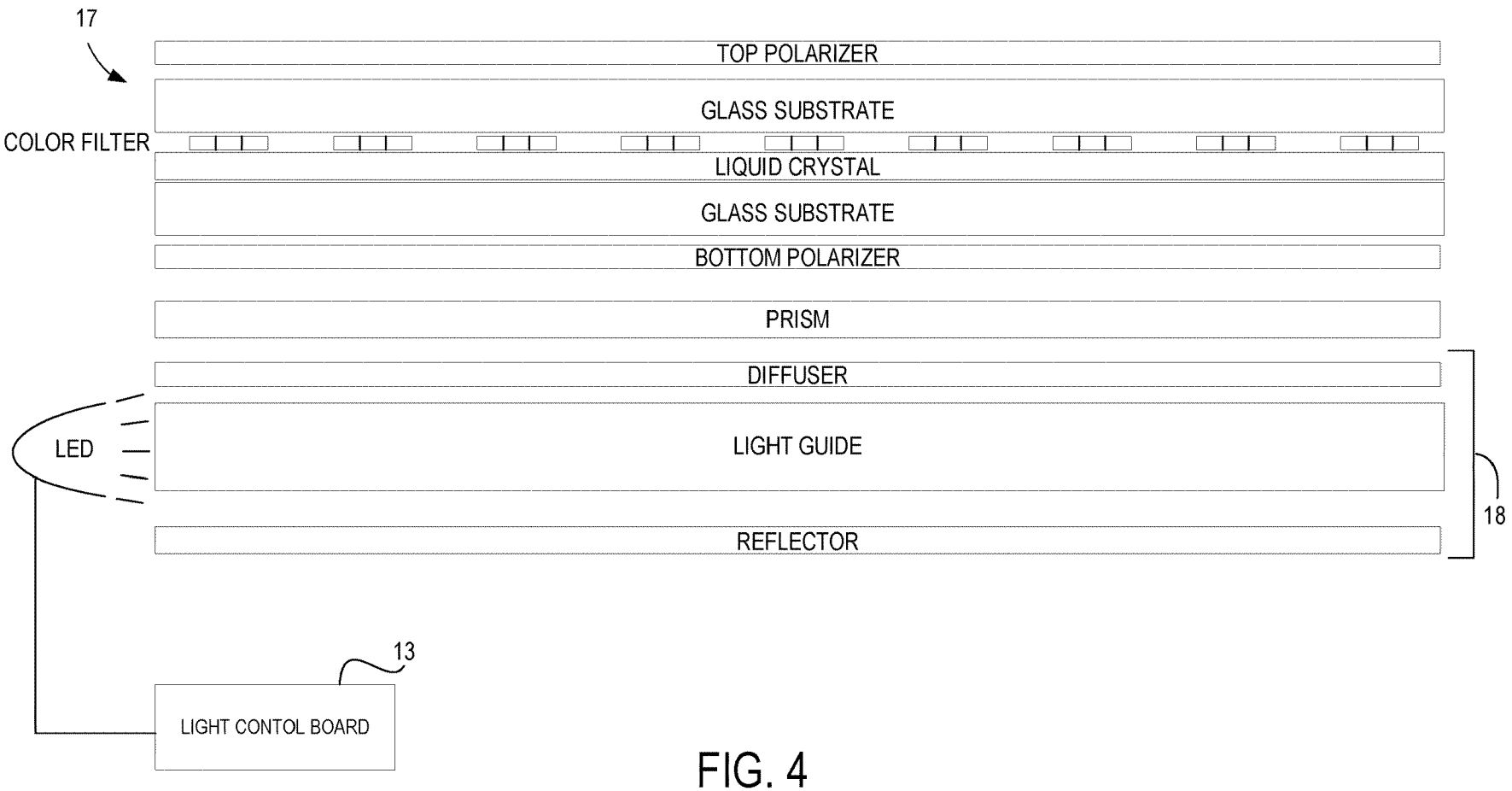
FIG. 4 is an example LED-backlit liquid crystal display.

FIG. 4 shows an example implementation of an LED-backlit liquid crystal display. In this implementation, a light control board 13 including a PCB such as that depicted in FIG. 1 controls signals to LEDs via the output waveform. A reflector and light guide may send the LED light to a diffuser and prism of the display backlight 18, then through a polarizer bordering a first glass substrate. The liquid crystal may be layered over the first glass substrate and a color filter may be placed over the liquid crystal. A second glass substrate may be layered below a top polarizer that may complete the LCD display 17 as shown in FIG. 4.

Figure 5:
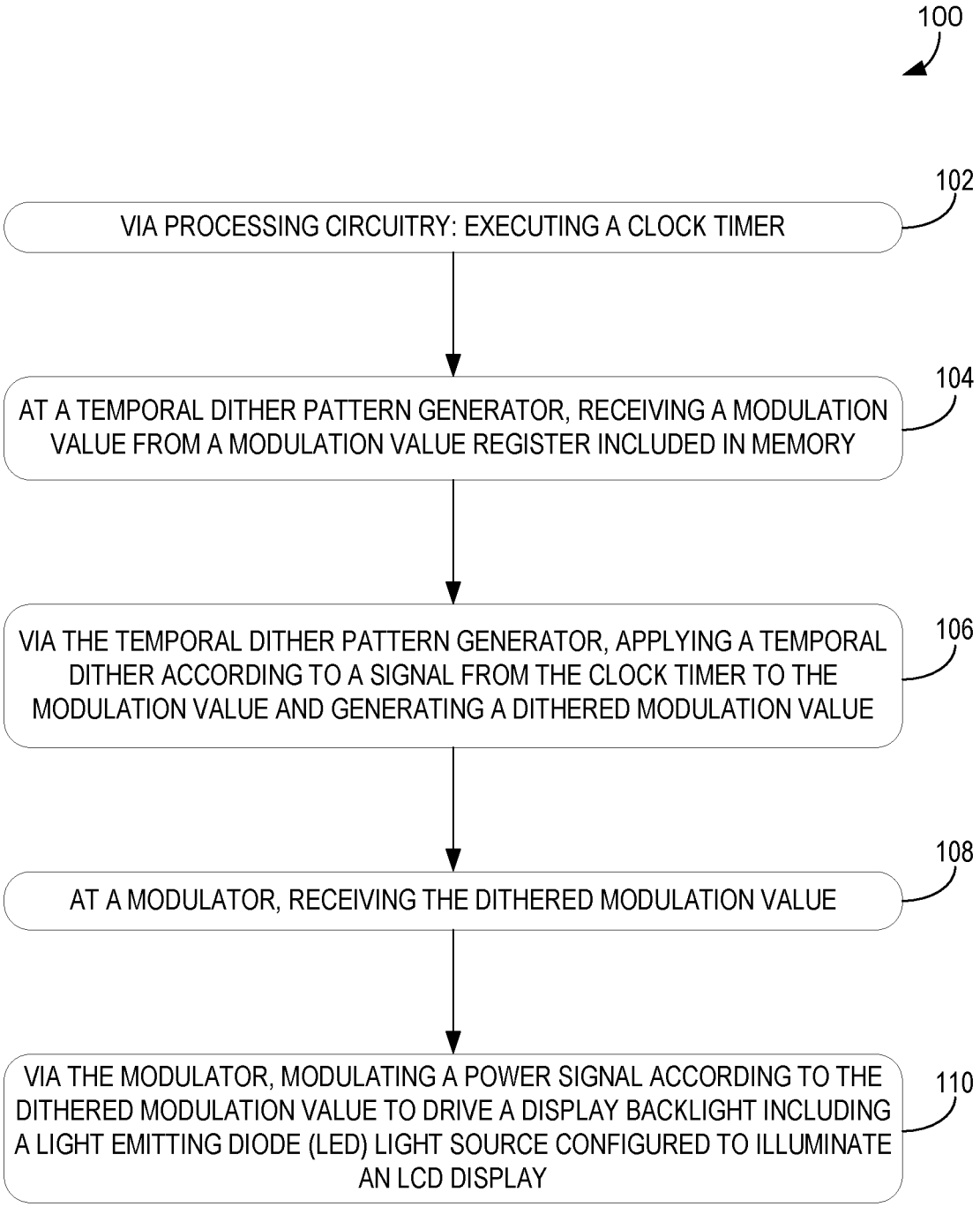
FIG. 5 is a flowchart of a method for executing the backlight control system of FIG. 1.

FIG. 5 shows a flowchart of a method 100 for executing a backlight control of an LCD display 17. The following description of method 100 is provided with reference to the backlight control system 12 described above and shown in FIGS. 1 and 2. It will be appreciated that method 100 may also be performed in other contexts using other suitable components.

With reference to FIG. 5 at 102, the method 100 may include, via processing circuitry 20, executing a clock timer 22. The method 100 at 104 may include, at a temporal dither pattern generator 24, receiving a modulation value 26 from a modulation value register 16 included in memory 14. At 106, the method 100 may include, via the temporal dither pattern generator 24, applying a temporal dither according to a signal from the clock timer 22 to the modulation value 26 and generating a dithered modulation value 28. The method 100 at 108 may include, at a modulator 30, receiving the dithered modulation value 28. At 110, the method 100 may include, via the modulator 30, modulating a power signal according to the dithered modulation value 28 to drive a display backlight 18 including a light emitting diode (LED) light source configured to illuminate the LCD display.

As described above, the temporal dither pattern generator 24 may apply the temporal dither to the modulation value 26 to generate a dithered modulation value 28 that increases a number of illumination value steps of the display backlight 18. The number of illumination value steps at which the display backlight 18 is controlled to be illuminated may not be limited to, i.e. may differ from, a modulation value resolution of the modulation value register 16.

As also described above, a modulation value resolution of the modulation value register 16 may be greater than a modulator resolution of the modulator 30. The temporal dither may be applied at least when the modulator 30 executes at one pulse width 32 within a dither cycle. The temporal dither may be applied when the modulator 30 executes at a plurality of pulse widths 32, or at all pulse widths 32 within a dither cycle.

The temporal dither pattern generator 24 may be included in a hardware component selected from the group consisting of an application-specific integrated circuit (ASIC), a field-programmable gate array (FPGA), an integrated circuit, and a microcontroller. The modulator 30 may execute at least one modulation selected from the group consisting of pulse width modulation and current modulation. The temporal dither applied by the temporal dither pattern generator may have a frequency of greater than 60 Hz and the modulator may be configured to modulate the modulated power signal at a modulation frequency of less than 100 kHz. As explained in the discussion above, the dither cycle may be less than 16.7 milliseconds and the modulation cycle may be greater than 10 microseconds.

The systems and methods discussed above have the potential advantage that they enable fine control over backlight luminance, thereby improving performance of the display from a human factors point of view, while not requiring costly or time-consuming hardware redesign of existing displays. Users of a display device so equipped may appreciate reduced distraction, disruption, and potential visual advantages of perceivably continuous luminance control.

In some embodiments, the methods and processes described herein may be tied to a computing system of one or more computing devices. In particular, such methods and processes may be implemented as a computer-application program or service, an application-programming interface (API), a library, and/or other computer-program product.

Figure 6:
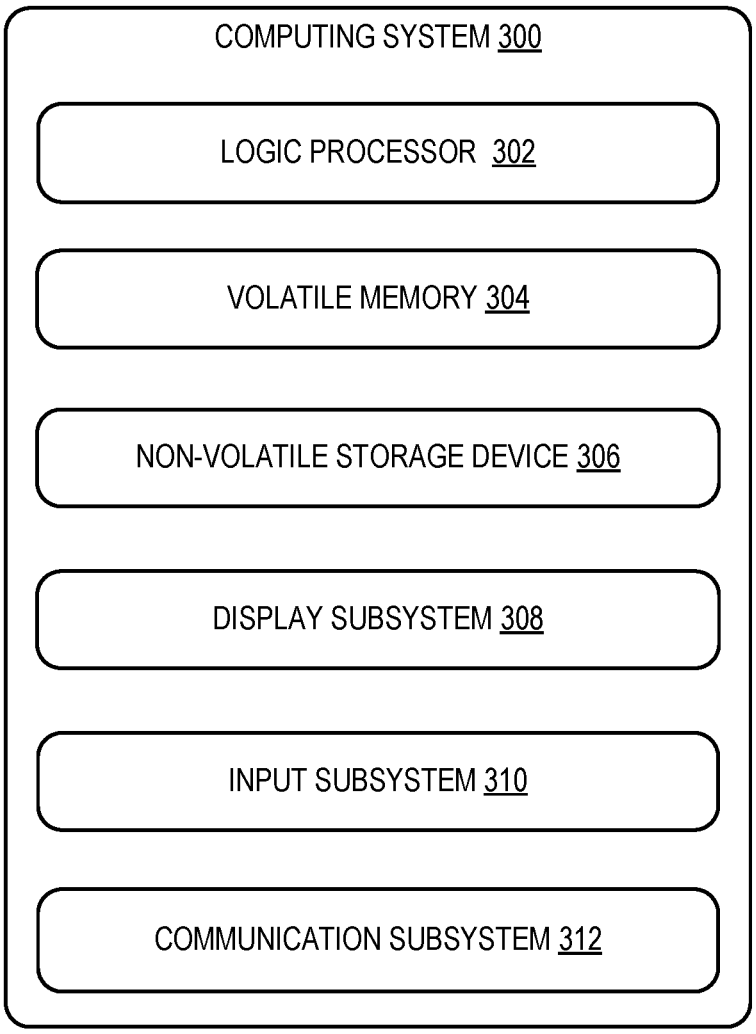
FIG. 6 is an example computing system according to an implementation of the present description.

FIG. 6 schematically shows a non-limiting embodiment of a computing system 300 that can enact one or more of the methods and processes described above. Computing system 300 is shown in simplified form. Computing system 300 may, for example, embody the system 12 of FIG. 1, or may instead embody some other computing system. Computing system 300 may take the form of one or more personal computers, server computers, tablet computers, home-entertainment computers, network computing devices, gaming devices, mobile computing devices, mobile communication devices (e.g., smart phone), and/or other computing devices, and wearable computing devices such as smart wristwatches and head mounted augmented/virtual reality devices.

Computing system 300 includes a logic processor 302, volatile memory 304, and a non-volatile storage device 306. Computing system 300 may optionally include a display subsystem 308, input subsystem 310, communication subsystem 312, and/or other components not shown in FIG. 6.

Logic processor 302 includes one or more physical devices configured to execute instructions. For example, the logic processor may be configured to execute instructions that are part of one or more applications, programs, routines, libraries, objects, components, data structures, or other logical constructs. Such instructions may be implemented to perform a task, implement a data type, transform the state of one or more components, achieve a technical effect, or otherwise arrive at a desired result.

The logic processor 302 may include one or more physical processors (hardware) configured to execute software instructions. Additionally or alternatively, the logic processor 302 may include one or more hardware logic circuits or firmware devices configured to execute hardware-implemented logic or firmware instructions. Processors of the logic processor 302 may be single-core or multi-core, and the instructions executed thereon may be configured for sequential, parallel, and/or distributed processing. Individual components of the logic processor 302 optionally may be distributed among two or more separate devices, which may be remotely located and/or configured for coordinated processing. Aspects of the logic processor may be virtualized and executed by remotely accessible, networked computing devices configured in a cloud-computing configuration. In such a case, these virtualized aspects may be run on different physical logic processors of various different machines.

Volatile memory 304 may include physical devices that include random access memory. Volatile memory 304 is typically utilized by logic processor 302 to temporarily store information during processing of software instructions. It will be appreciated that volatile memory 304 typically does not continue to store instructions when power is cut to the volatile memory 304.

Non-volatile storage device 306 includes one or more physical devices configured to hold instructions executable by the logic processors to implement the methods and processes described herein. When such methods and processes are implemented, the state of non-volatile storage device 306 may be transformed—e.g., to hold different data.

Non-volatile storage device 306 may include physical devices that are removable and/or built-in. Non-volatile storage device 306 may include optical memory (e.g., CD, DVD, HD-DVD, Blu-Ray Disc, etc.), semiconductor memory (e.g., ROM, EPROM, EEPROM, FLASH memory, etc.), and/or magnetic memory (e.g., hard-disk drive, floppy-disk drive, tape drive, MRAM, etc.), or other mass storage device technology. Non-volatile storage device 306 may include nonvolatile, dynamic, static, read/write, read-only, sequential-access, location-addressable, file-addressable, and/or content-addressable devices. It will be appreciated that non-volatile storage device 306 is configured to hold instructions even when power is cut to the non-volatile storage device 306.

Aspects of logic processor 302, volatile memory 304, and non-volatile storage device 306 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The term "program" may be used to describe an aspect of computing system 300 implemented to perform a particular function. In some cases, a program may be instantiated via logic processor 302 executing instructions held by non-volatile storage device 306, using portions of volatile memory 304. It will be understood that different programs may be instantiated from the same application, service, code block, object, library, routine, API, function, etc. Likewise, the same program may be instantiated by different applications, services, code blocks, objects, routines, APIs, functions, etc. The term "program" encompasses individual or groups of executable files, data files, libraries, drivers, scripts, database records, etc.

When included, display subsystem 308 may be used to present a visual representation of data held by non-volatile storage device 306. As the herein described methods and processes change the data held by the non-volatile storage device 306, and thus transform the state of the non-volatile storage device 306, the state of display subsystem 308 may likewise be transformed to visually represent changes in the underlying data. Display subsystem 308 may include one or more display devices utilizing virtually any type of technology. Such display devices may be combined with logic processor 302, volatile memory 304, and/or non-volatile storage device 306 in a shared enclosure, or such display devices may be peripheral display devices.

When included, input subsystem 310 may comprise or interface with one or more user-input devices such as a keyboard, mouse, touch screen, or game controller. In some embodiments, the input subsystem 310 may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection, gaze detection, and/or intent recognition; as well as electric-field sensing componentry for assessing brain activity; and/or any other suitable sensor.

When included, communication subsystem 312 may be configured to communicatively couple computing system 300 with one or more other computing devices. Communication subsystem 312 may include wired and/or wireless communication devices compatible with one or more different communication protocols. As non-limiting examples, the communication subsystem 312 may be configured for communication via a wireless telephone network, or a wired or wireless local- or wide-area network. In some embodiments, the communication subsystem 312 may allow computing system 300 to send and/or receive messages to and/or from other devices via a network such as the Internet.

The following paragraphs provide additional support for the claims of the subject application. One aspect provides a backlight control system comprising memory including a modulation value register and a display backlight including a light emitting diode (LED) light source configured to illuminate a liquid crystal display (LCD) display. Processing circuitry included in the backlight control system is configured to execute a clock timer and a temporal dither pattern generator. The temporal dither pattern generator is configured to receive a modulation value from the modulation value register and apply a temporal dither according to a signal from the clock timer to the modulation value to generate a dithered modulation value. The processing circuitry is further configured to execute a modulator that is configured to receive the dithered modulation value and modulate a power signal according to the dithered modulation value to drive the display backlight.

In this aspect, additionally or alternatively, the temporal dither pattern generator may apply the temporal dither to the modulation value to generate a dithered modulation value that may increase a number of illumination value steps of the display backlight. In this aspect, additionally or alternatively, the number of illumination value steps at which the display backlight is controlled to be illuminated may differ from a modulation value resolution of the modulation value register. In this aspect, additionally or alternatively, a modulation value resolution of the modulation value register may be greater than a modulator resolution of the modulator. In this aspect, additionally or alternatively, the temporal dither may be applied at least when the modulator executes at one pulse width within a dither cycle. In this aspect, additionally or alternatively, the temporal dither may be applied when the modulator executes at a plurality of pulse widths within a dither cycle.

In this aspect, additionally or alternatively, the temporal dither pattern generator may be included in a hardware component selected from the group consisting of an application-specific integrated circuit (ASIC), a field-programmable gate array (FPGA), an integrated circuit, and a microcontroller. In this aspect, additionally or alternatively, the modulator may execute at least one modulation selected from the group consisting of pulse width modulation and current modulation. In this aspect, additionally or alternatively, the temporal dither applied by the temporal dither pattern generator may have a frequency of greater than 60 Hz and the modulator may be configured to modulate the modulated power signal at a modulation frequency of less than 100 kHz.

Another aspect provides a method for executing a backlight control of a liquid crystal display (LCD) display. The method comprises, via processing circuitry, executing a clock timer and, at a temporal dither pattern generator, receiving a modulation value from a modulation value register included in memory. The method further comprises, via the temporal dither pattern generator, applying a temporal dither according to a signal from the clock timer to the modulation value and generating a dithered modulation value. The method further comprises, at a modulator, receiving the dithered modulation value and, via the modulator, modulating a power signal according to the dithered modulation value to drive a display backlight including a light emitting diode (LED) light source configured to illuminate the LCD display.

In this aspect, additionally or alternatively, the temporal dither pattern generator may apply the temporal dither to the modulation value to generate a dithered modulation value that may increase a number of illumination value steps of the display backlight. In this aspect, additionally or alternatively, the number of illumination value steps at which the display backlight is controlled to be illuminated may differ from a modulation value resolution of the modulation value register. In this aspect, additionally or alternatively, a modulation value resolution of the modulation value register may be greater than a modulator resolution of the modulator. In this aspect, additionally or alternatively, the temporal dither may be applied at least when the modulator executes at one pulse width within a dither cycle. In this aspect, additionally or alternatively, the temporal dither may be applied when the modulator executes at a plurality of pulse widths within a dither cycle.

In this aspect, additionally or alternatively, the temporal dither pattern generator may be included in a hardware component selected from the group consisting of an application-specific integrated circuit (ASIC), a field-programmable gate array (FPGA), an integrated circuit, and a microcontroller. In this aspect, additionally or alternatively, the modulator may execute at least one modulation selected from the group consisting of pulse width modulation and current modulation. In this aspect, additionally or alternatively, the temporal dither applied by the temporal dither pattern generator may have a frequency of greater than 60

Hz and the modulator may be configured to modulate the modulated power signal at a modulation frequency of less than 100 kHz.

Another aspect provides a backlight control system comprising a memory including a modulation value register and a display backlight including a light emitting diode (LED) light source configured to illuminate a liquid crystal display (LCD) display. Processing circuitry included in the backlight control system is configured to execute a clock timer and a temporal dither pattern generator. The temporal dither pattern generator is configured to receive a modulation value from the modulation value register, and apply a temporal dither according to a signal from the clock timer to the modulation value to generate a dithered modulation value. The processing circuitry is further configured to execute a modulator configured to receive the dithered modulation value and modulate a power signal according to the dithered modulation value to drive the display backlight. The temporal dither pattern generator applies the temporal dither to the modulation value to generate a dithered modulation value that increases a number of illumination value steps of the display backlight. The modulation value resolution of the modulation value register is greater than a modulator resolution of the modulator.

In this aspect, additionally or alternatively, the modulator may execute at least one modulation selected from the group consisting of pulse width modulation and current modulation.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A backlight control system, comprising:

memory including a modulation value register;

a display backlight including a light emitting diode (LED) light source configured to illuminate a liquid crystal display (LCD) display;

processing circuitry configured to execute:

a clock timer;

a temporal dither pattern generator configured to receive a modulation value having a modulation cycle from the modulation value register, and apply a temporal dither according to a signal from the clock timer to the modulation value to generate a dithered modulation value that increases a number of illumination value steps of the display backlight for the modulation value over a plurality of successive modulation cycles by varying a duty cycle over the plurality of successive modulation cycles; and a modulator configured to receive the dithered modulation value and modulate a power signal according to the dithered modulation value to drive the display backlight.

2. The control system of claim 1, wherein the temporal dither is applied at least when the modulator executes at one pulse width within a dither cycle.

3. The control system of claim 1, wherein the temporal dither is applied when the modulator executes at a plurality of pulse widths within a dither cycle.

4. The control system of claim 1, wherein the temporal dither pattern generator is included in a hardware component selected from the group consisting of an application-specific integrated circuit (ASIC), a field-programmable gate array (FPGA), an integrated circuit, and a microcontroller.

5. The control system of claim 1, wherein the modulator executes at least one modulation selected from the group consisting of pulse width modulation and current modulation.

6. The control system of claim 1, wherein the temporal dither applied by the temporal dither pattern generator has a frequency of greater than 60 Hz and the modulator is configured to modulate the modulated power signal at a modulation frequency of less than 100 kHz.

7. A method for executing a backlight control of a liquid crystal display (LCD) display, the method comprising:

via processing circuitry:

executing a clock timer;

at a temporal dither pattern generator, receiving a modulation value having a modulation cycle from a modulation value register included in memory;

via the temporal dither pattern generator, applying a temporal dither according to a signal from the clock timer to the modulation value and generating a dithered modulation value that increases a number of illumination value steps of the display backlight for the modulation value over a plurality of successive modulation cycles by varying a duty cycle over the plurality of successive modulation cycles;

at a modulator, receiving the dithered modulation value; and via the modulator, modulating a power signal according to the dithered modulation value to drive a display backlight including a light emitting diode (LED) light source configured to illuminate the LCD display.

8. The method of claim 7, wherein the temporal dither is applied at least when the modulator executes at one pulse width within a dither cycle.

9. The method of claim 7, wherein the temporal dither is applied when the modulator executes at a plurality of pulse widths within a dither cycle.

10. The method of claim 7, wherein the temporal dither pattern generator is included in a hardware component selected from the group consisting of an application-specific integrated circuit (ASIC), a field-programmable gate array (FPGA), an integrated circuit, and a microcontroller.

11. The method of claim 7, wherein the modulator executes at least one modulation selected from the group consisting of pulse width modulation and current modulation.

12. The method of claim 7, wherein the temporal dither applied by the temporal dither pattern generator has a frequency of greater than 60 Hz and the modulator is configured to modulate the modulated power signal at a modulation frequency of less than 100 kHz.

* * * * *